US011891216B2

(12) United States Patent
Messerle

(10) Patent No.: US 11,891,216 B2
(45) Date of Patent: Feb. 6, 2024

(54) PACKAGING

(71) Applicant: Heiner Messerle, Höchst (AT)

(72) Inventor: Heiner Messerle, Höchst (AT)

( * ) Notice: Subject to any disclaimer, the term of this patent is extended or adjusted under 35 U.S.C. 154(b) by 0 days.

(21) Appl. No.: 17/713,591

(22) Filed: Apr. 5, 2022

(65) Prior Publication Data

US 2022/0324618 A1 Oct. 13, 2022

(30) Foreign Application Priority Data

Apr. 8, 2021 (AT) ..... A 75/2021

(51) Int. Cl.
*B65D 43/02* (2006.01)
*B65D 5/24* (2006.01)

(52) U.S. Cl.
CPC ..... *B65D 43/0212* (2013.01); *B65D 5/244* (2013.01); *B65D 2543/00194* (2013.01); *B65D 2543/00296* (2013.01); *B65D 2543/00537* (2013.01); *B65D 2543/00666* (2013.01); *B65D 2543/00759* (2013.01)

(58) Field of Classification Search
CPC ..... B65D 43/0212; B65D 15/22; B65D 43/0204; B65D 2543/00194
See application file for complete search history.

(56) References Cited

U.S. PATENT DOCUMENTS

| | | | | |
|---|---|---|---|---|
| 3,795,360 | A | 3/1974 | Bianchi et al. | |
| 5,201,828 | A | 4/1993 | Martin | |
| 2008/0054059 | A1 | 3/2008 | Chadima | |
| 2015/0210442 | A1* | 7/2015 | Frankel | B65D 43/021 220/315 |
| 2018/0303260 | A1* | 10/2018 | Vukkisila | B65D 1/34 |

FOREIGN PATENT DOCUMENTS

| | | |
|---|---|---|
| DE | 2819708 | 11/1978 |
| EP | 3705415 | 10/2021 |
| GB | 1598947 | 9/1981 |
| KR | 20100006304 | 6/2010 |
| WO | 2014009684 | 7/2013 |

* cited by examiner

*Primary Examiner* — Jeffrey R Allen
(74) *Attorney, Agent, or Firm* — Volpe Koenig

(57) ABSTRACT

A packaging, in particular for foodstuffs, including a tray (1) made of cardboard or paperboard and a lid (51), which, when the packaging is in the closed state, is fitted on the tray, wherein lugs (57) of the lid (51) engage in openings (7) which are formed in wall portions (8) of at least two opposite side walls (2, 4) of the tray. The side walls of the tray which have the openings have, in each case in the region above the wall portion which has the at least one opening, a freely upwardly projecting tongue (9), which is connected via a bending line (10) to the wall portion which has the at least one opening, and is located beneath the tongue. In the fitted state of the lid, the tongues of the side walls butt against sloping portions (59) of the lid.

10 Claims, 5 Drawing Sheets

Fig. 1
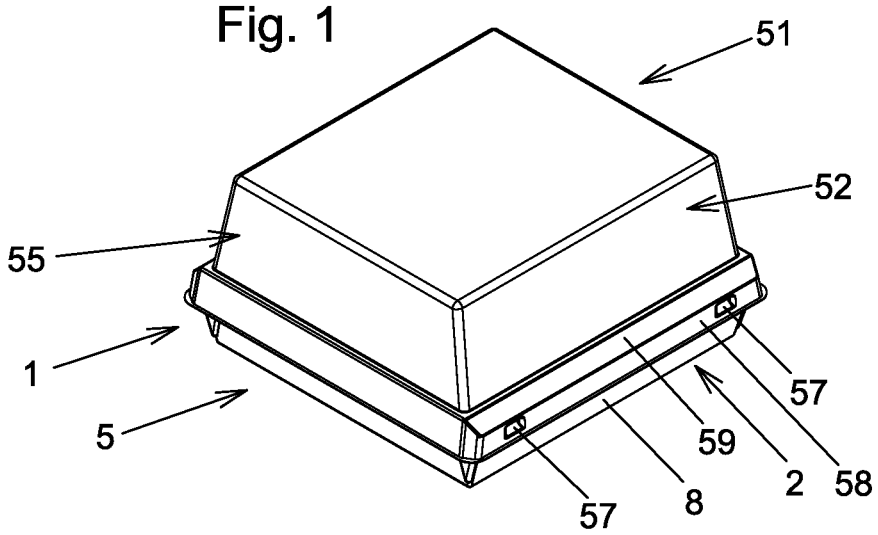
Fig. 2
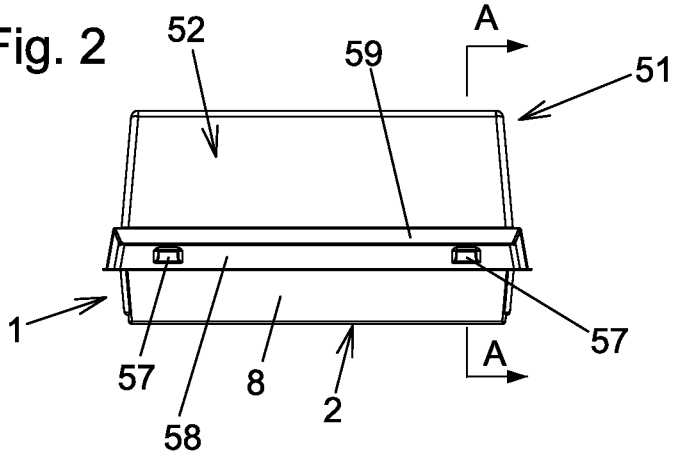
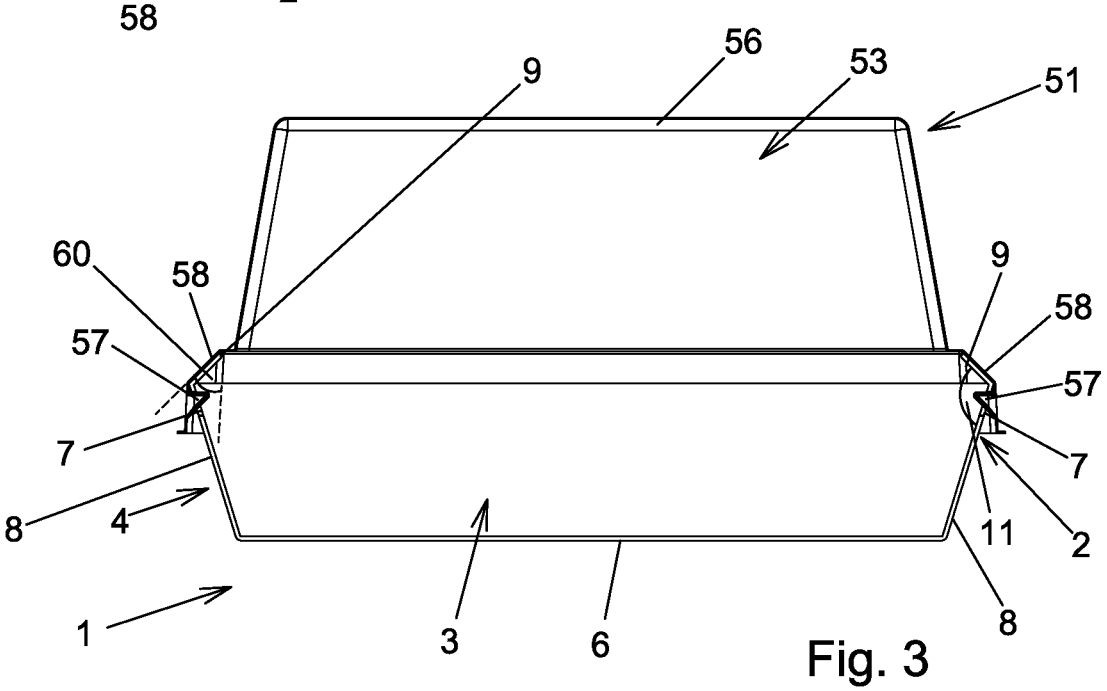
Fig. 3

Fig. 4
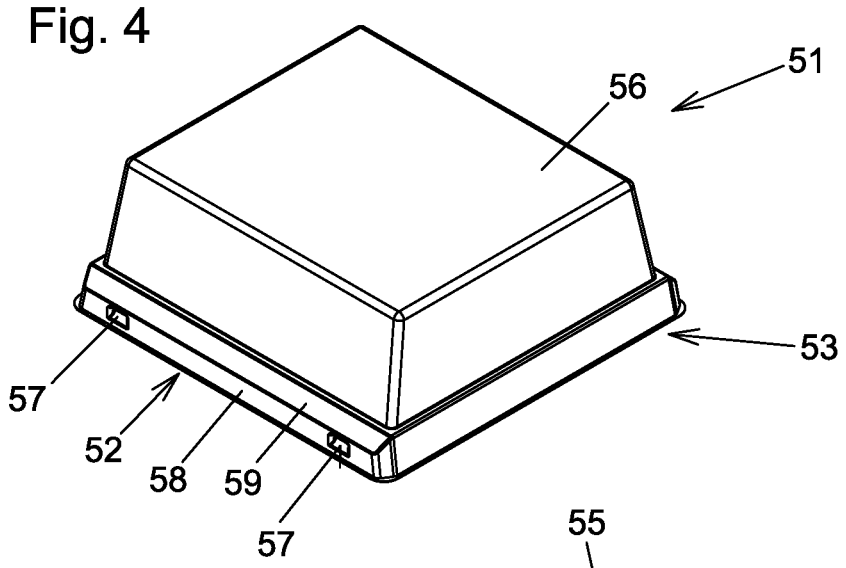
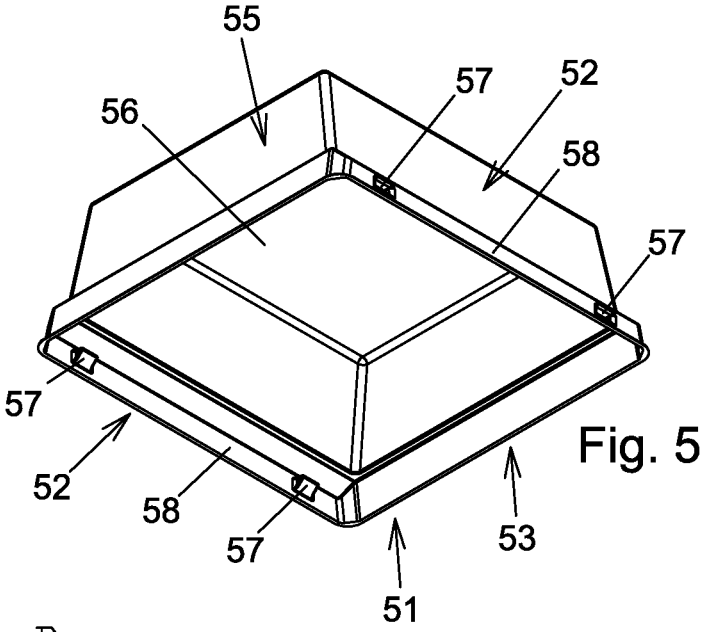
Fig. 5
Fig. 6
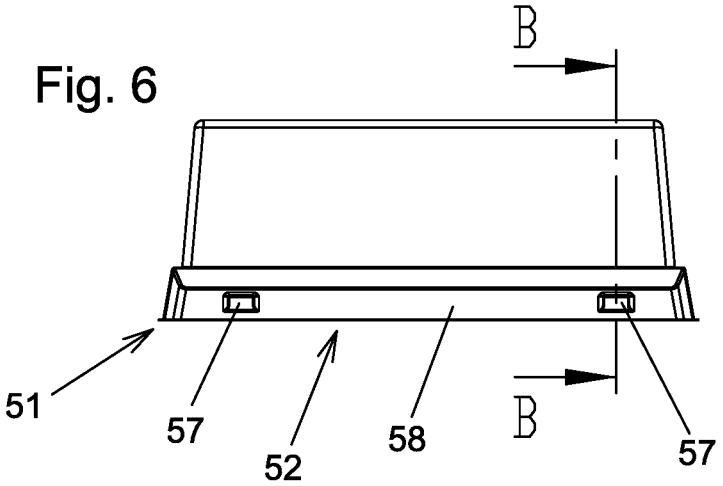

Fig. 10
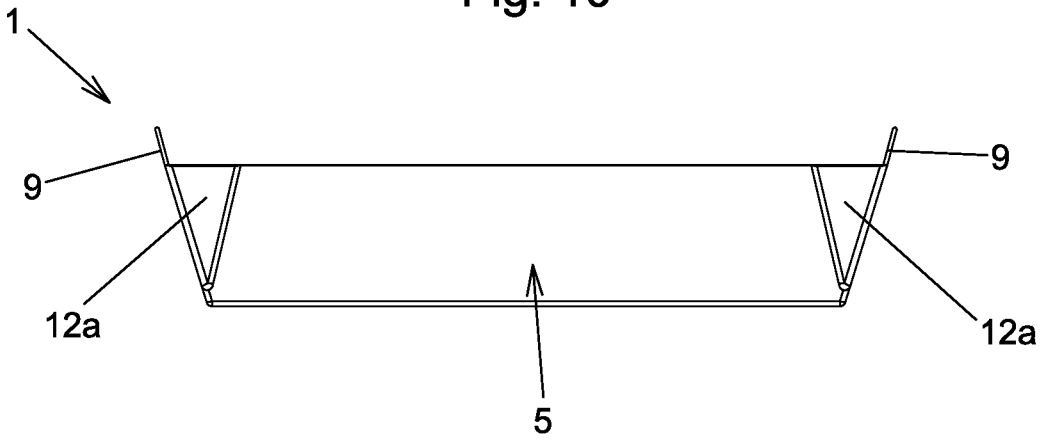
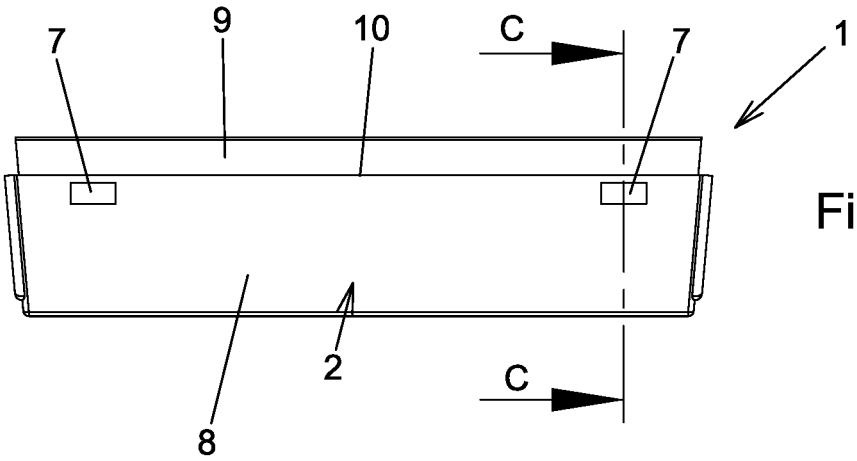
Fig. 11
Fig. 12
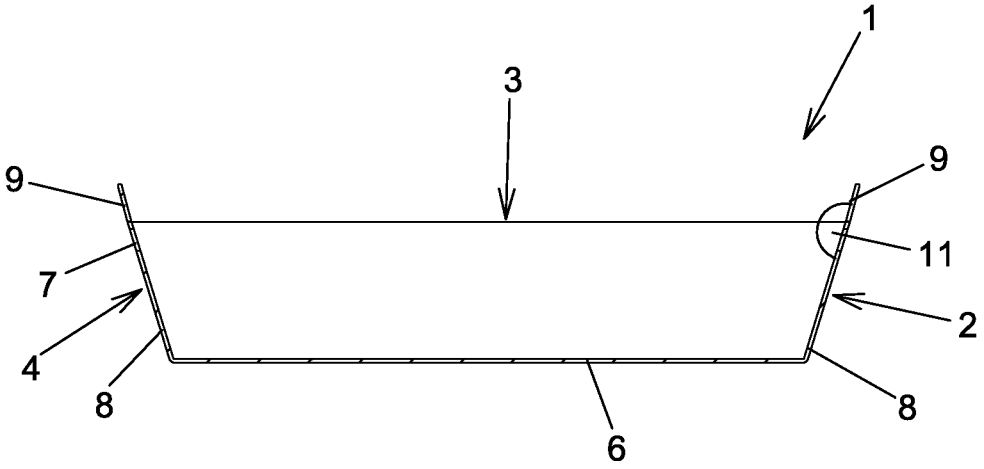

PACKAGING

INCORPORATION BY REFERENCE

The following documents are incorporated herein by reference as if fully set forth: Austrian Patent Application No. A75/2021, filed Apr. 8, 2021.

TECHNICAL FIELD

The invention relates to a packaging, in particular for foodstuffs, comprising a tray made of cardboard or paperboard and a lid which, when the packaging is in the closed state, is fitted on the tray and engages on the outside over an upper edge of the tray, wherein inwardly protruding lugs are provided for holding the lid on the tray, the lugs being arranged on wall portions of at least two opposite side walls of the lid and engaging in openings which are formed in wall portions of at least two opposite side walls of the tray, and wherein at least these side walls of the lid have, in each case in the region above the at least one lug, a sloping portion which runs in an inclined state in relation to the vertical direction and by means of which the extent of the lid increases from top to bottom.

BACKGROUND

Packaging for foodstuffs, for example cakes, pastries, ready meals or salad, which comprise a tray made of plastic and a hat-form lid made of plastic, which is fitted on the tray, wherein side walls of the lid have protruding lugs which interact with restraining elements on the side walls of the tray, are known. At least the plastic of the lid, and possibly also the plastic of the tray, can be of transparent design. Such packaging is also referred to as blister packs.

In order to reduce the amount of plastic waste, it has already been proposed to form the tray from cardboard or paperboard. However, previously known "hybrid" packaging of this type is disadvantageous in various respects, in particular in respect of handling and/or stability, including how the fitted lid is held on the tray, and/or production.

A tray of the type mentioned in the introduction is disclosed in EP 3 705 415 A1. Opposite side walls of the tray here have, on the outer sides, triangular hollow channels which are formed by virtue of first and second stiffening portions being bent or folded over and an adhesive-bonding portion which respectively adjoins the second stiffening portion being adhesively bonded to the outer side of a respective wall portion of the tray. The second stiffening portions delimit the triangular hollow channels on the underside and can have openings in which the lugs of the fitted lid engage. This tray is easy to handle and has good stability, and the lid is held in a stable manner, but production involves increased outlay. It is also the case that the hollow channels formed on the outer sides of the opposite side walls increase the amount of space required for stacking.

SUMMARY

The object of the invention is to provide an advantageous packaging which is of the type mentioned in the introduction and, along with having good stability, is easy to produce and handle. This object is achieved by a packaging having one or more of the features described herein.

In the case of the packaging according to the invention, at least the side walls of the tray which have the openings have, in each case in the region above the wall portion which has at least one opening, a freely upwardly projecting tongue. The latter is connected via a bending line to the wall portion which has the at least one opening and is located beneath the tongue. In the fitted state of the lid, the tongues of the side walls butt against the sloping portions of the lid.

Since, in the fitted state of the lid, there is a bend, that is to say an angle of less than 180°, preferably less than 150°, between a respective tongue and the wall portion which has the at least one opening, is located beneath the tongue and to which the tongue is connected via the bending line, the wall portions which have the openings are stabilized. This counteracts bulging of these wall portions in the outward direction. It also counteracts the undesirable pushing out of the lugs of the lid from the openings.

When the lid is not fitted, it is possible, in an advantageous embodiment, for a respective tongue and the wall portion which is located beneath it and to which it is connected via the bending line to be located in a common plane. It is thus possible to provide for an advantageous stackability of the trays. However, it would also be conceivable and possible for there to be a bend between a respective tongue and the wall portion which has the at least one opening, and is located beneath the tongue, even when the lid is not fitted. For example, the tongues could be oriented vertically, whereas the wall portions located beneath them run in an inclined state in relation to the vertical direction such that the extent of the tray increases from bottom to top. Even in the case of such a design, the tray would advantageously be stackable and further bending or folding over of the tongues when the tongue is being fitted would be easier in comparison with the design in which the tongues and the wall portions located beneath them are located in a single plane when the lid is not fitted. It would also be possible, when the lid is not fitted, for a respective one of the tongues to be located between the vertical position and the position in which it is located in a common plane with the wall portion located beneath it.

In any case, it is preferred if, when the lid is being fitted on the tray, the interaction of the respective sloping portion of the lid with the associated tongue of the tray decreases the angle between the tongue and the wall portion which has the at least one opening and to which this tongue is connected via the bending line.

A respective tongue advantageously extends over more than half the length of the wall portion (measured in the horizontal direction) to which it is connected via the bending line, wherein a value of more than two thirds is preferred and it is particularly preferred if the tongue extends over at least essentially the entire length of this wall portion.

BRIEF DESCRIPTION OF THE DRAWINGS

Further advantages and details of the invention will be explained hereinbelow with reference to the accompanying drawing, in which:

FIG. 1 shows an oblique view of an exemplary embodiment of a packaging according to the invention with the tray and the lid in the assembled state;

FIG. 2 shows a side view of the packaging;

FIG. 3 shows a section taken along line AA from FIG. 2;

FIGS. 4 and 5 show oblique views of the lid from different viewing directions;

FIG. 6 shows a side view of the lid;

FIGS. 10 and 11 show side views of the tray;

FIG. 12 shows a section taken along line CC from FIG. 11; and

DETAILED DESCRIPTION

Figure 7:
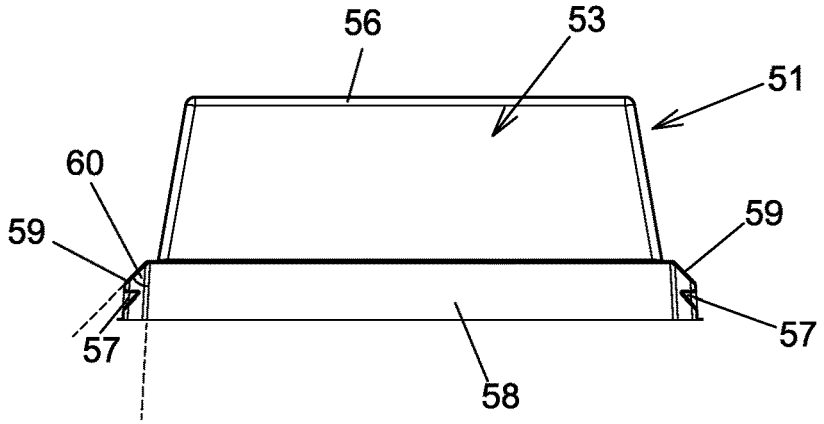
FIG. 7 shows a section taken along line BB from FIG. 6.
Figure 8:
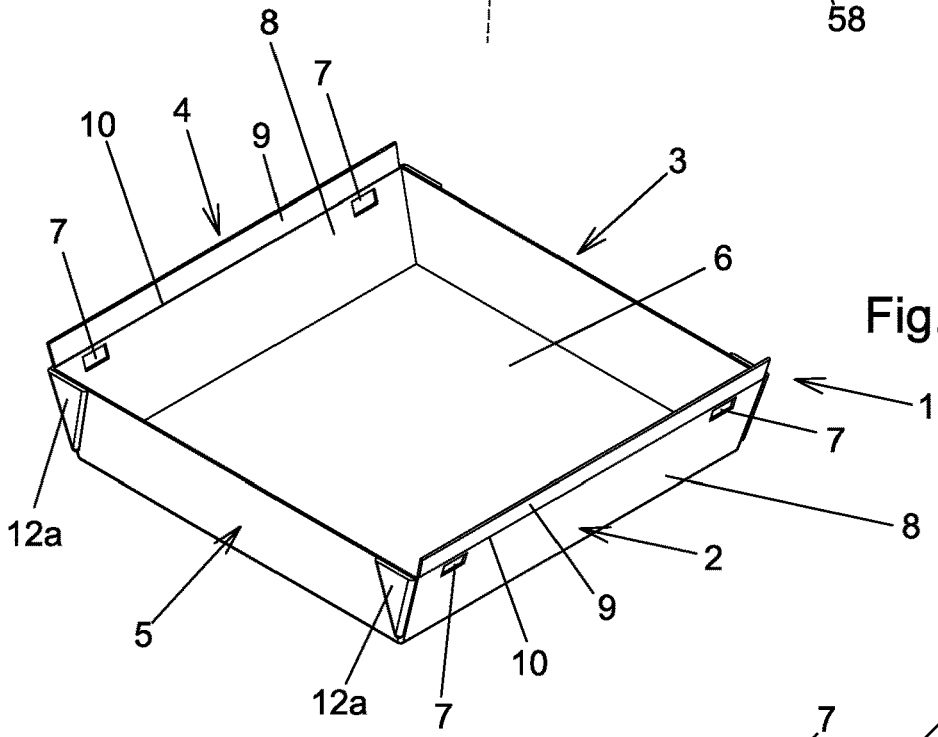
FIGS. 8 and 9 show oblique views of the tray from different viewing directions.
Figure 9:
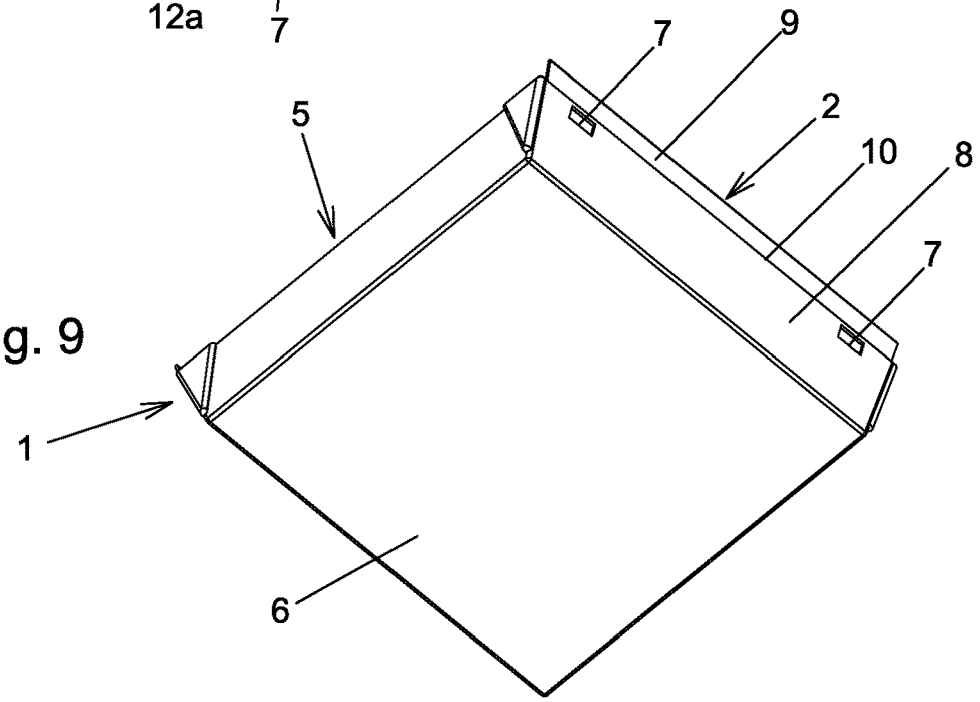

An exemplary embodiment of the invention will be explained hereinbelow with reference to FIGS. 1 to 13. The packaging is formed by a tray 1 made of cardboard or paperboard and a lid 51 made of preferably transparent plastic, for example PET. The lid 51 has side walls 52-55, which project downward from a rectangular or square top 56. The tray 1 has side walls 2-5, which project upward from a rectangular or square bottom 6.

The lid 51 can be connected to the tray 1 via a snap-fit connection. For this purpose, opposite side walls 52, 54 of the lid 51 each have a wall portion 58, which has inwardly protruding lugs 57. In an exemplary embodiment, two such lugs 57, which are spaced apart in a horizontal direction, are formed on the respective wall portion 58. It would also be possible for more than two such lugs to be present. The use of just one such lug on the respective wall portion is possible in principle, but is less preferred. In the exemplary embodiment, the wall portions 58 which have the lugs 57 adjoin the lower edge of the lid 51.

The lid 51 has a respective sloping portion 59 above the wall portions 58 which have the lugs 57. A respective sloping portion 59 is located in an inclined state in relation to the vertical direction such that the extent of the lid 51 measured between these two opposite side walls increases from bottom to top. The angle 60 by which the respective sloping portion 59 is inclined in relation to the vertical preferably ranges from 35° to 55°.

In the exemplary embodiment, a bend is located between the respective sloping portion 59 and the wall portion 58 which has the at least one lug 57 and is located beneath the sloping portion. A connection provided by a rounded portion is also conceivable and possible.

Opposite side walls 2, 4 of the tray 1 have wall portions 8 with openings (=window openings) 7 which are provided for interacting with the lugs 57 of the lid 51. In the state in which the lid 51 is fitted on the tray 1, the lid 51 engages on the outside over an upper edge of the tray 1, wherein the lugs 57 have latched into the openings 7.

In the exemplary embodiment, it is therefore the case that each of the two opposite wall portions 8 has two horizontally spaced-apart openings 7, wherein, depending on the design of the lids, it would also be possible to provide more or fewer openings of this kind.

The wall portions 8 are connected at their two side edges to the respectively adjacent side wall 3, 5. This connection will be explained in yet more detail hereinbelow.

The wall portions which have the openings 7 are preferably located in an inclined state in relation to the vertical direction such that the extent of the tray 1 (measured in the horizontal direction) increases from bottom to top. The angle of inclination of the wall portions 8 in relation to the vertical preferably ranges from 5° to 25°. It is also the case that the other side walls 3, 5 are preferably located in such an inclined state in relation to the vertical direction.

A respective tongue 9 projects freely upward from the wall portions 8, i.e. the respective tongue 9 is free, that is to say not connected directly to the respectively adjacent side wall 3, 5, both at its edge which is located opposite the wall portion 8 and at its two side edges. The connection to the wall portion 8 which is located beneath it is established via a bending line 10. The tongue 9 can therefore be pivoted about the bending line 10 in relation to the wall portion 8 located beneath it. Proceeding from the state assumed by the tongue when the tray 1 and the lid 51 are in the unconnected state, the tongue 9 here provides a certain amount of resistance to being pivoted about the bending line 10. At any rate, the amount of resistance is great enough for the tongue 9 not to be swung downward by gravitational force alone into a position in which it butts against the wall portion 8 located beneath it.

In the exemplary embodiment shown, when the tray 1 and the lid 51 are in the unconnected state, a respective tongue 9 is located in a common plane with the wall portion 8 respectively located beneath it. In the exemplary embodiment therefore, when the tray 1 and the lid 51 are in the unconnected state, the angle 11 between the tongue 9 and the wall portion 8 located beneath it is 180°.

It would also be possible, when the tray 1 and the lid 51 are in the unconnected state, for this angle 11 to be smaller, although it is preferred for the angle 11 not to be smaller than an angle which corresponds to a vertical orientation of the respective tongue 9.

If, starting from the orientation it assumes when the tray 1 and the lid 51 are in the unconnected state, a tongue 9 is pivoted, then it provides a certain amount of resistance to this pivoting movement and preferably also provides a certain amount of restoring force which, once the force which causes the pivoting movement is no longer acting, returns the tongue, at least in part, into the previously assumed position.

If the lid 51 is being fitted on the tray 1, then the free end of a respective tongue 9 ends up in abutment with a respective sloping portion 59 of the lid 51 before the lugs 57 engage in the openings 7. As the lid 51 continues to be pushed on, the tongues 9 are thus pivoted in relation to the wall portion 8 respectively located beneath them, wherein the angle 11 decreases until the lugs 56 snap into the openings 7. In the snapped-together state of the lid 51 and the tray 1, the tongues 9 and the associated sloping portions 59 preferably butt against one another over their surface areas, i.e. they have the same angles of inclination in relation to the vertical, cf., in particular, FIG. 3.

Figure 13:
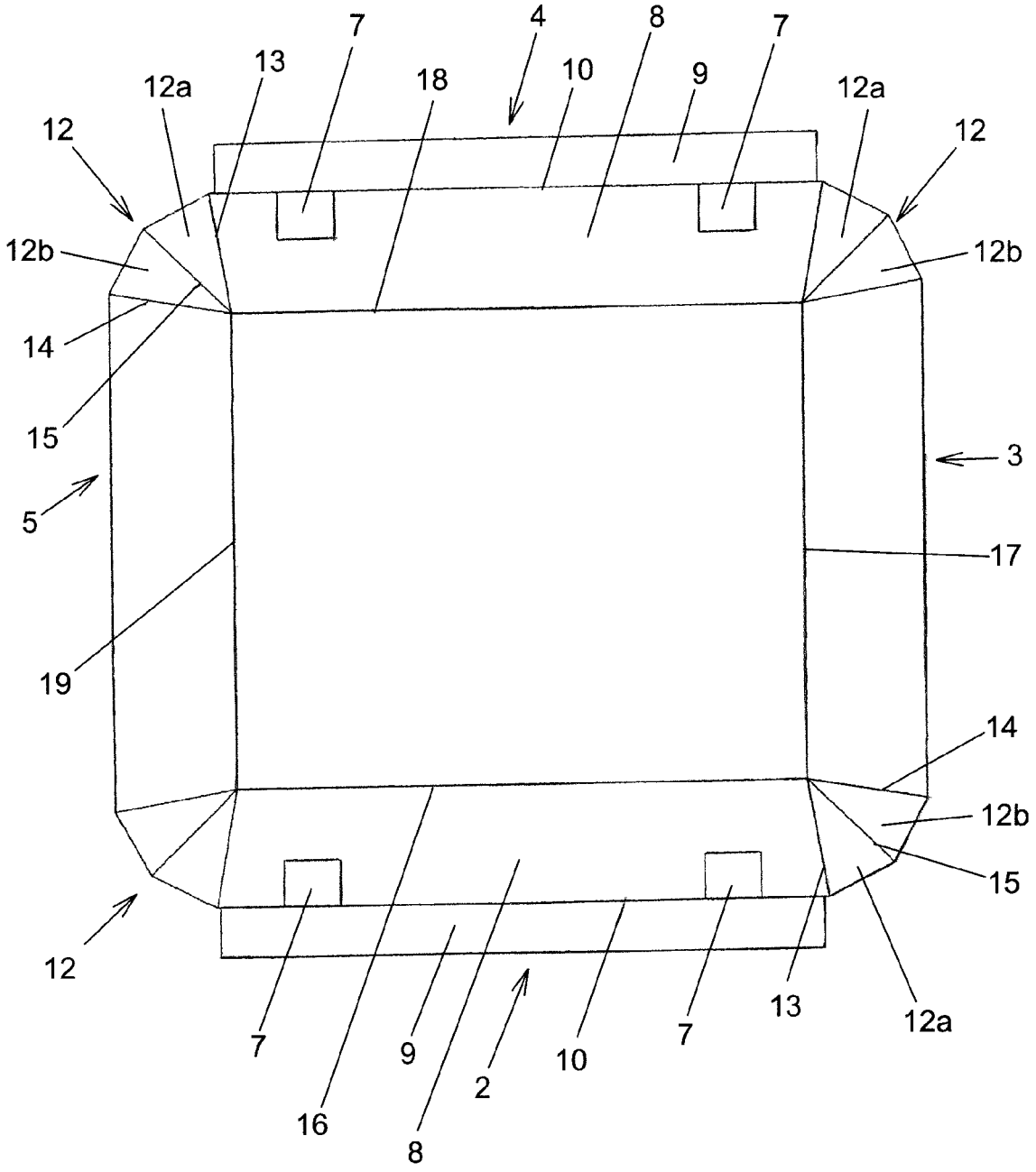
FIG. 13 shows a blank for forming the tray.

The tray 1 is formed from a blank which is made of cardboard or paperboard and is illustrated in FIG. 13 in the state in which it has been laid out flat on a planar underlying surface. A respective connecting portion 12 is located between the wall portions 8 of the side walls 2, 4 and the side walls 3, 5. A respective connecting portion 12 has a first and a second triangular portion 12*a*, 12*b*. The respective first triangular portion 12*a* is separated from the respectively adjacent wall portion 8 of the respective side wall 2, 4 by a bending line 13 which extends from the respective corner. The respective second triangular portion 12*b* is separated from the respectively adjacent side wall 3, 5 by a bending line 14 which extends form the respective corner. The first and the second triangular portions 12*a*, 12*b* are separated from one another by a bending line 15 which extends from the respective corner. This bending line 15 is at an angle of 135° in relation to the two side edges of the bottom which together enclose the corner.

In order for the tray 1 to be formed from the blank, the triangular portions 12*a*, 12*b* of a respective connecting portion 12 are folded together, so that they preferably project outward. The wall portions 8 of the side walls 2, 4 and also the side walls 3, 5 here are bent upward about the bending lines 16-19 in relation to the bottom 6. As a result, the folded-together triangular portions 12*a*, 12*b* are folded over in each case toward one of the side walls 2-5, preferably toward one of the side walls 2, 4, and are adhesively bonded thereto.

The bending lines 10, 13-19 are preferably formed by scored lines. In particular the bending lines 10 could also be formed as perforated lines.

Different modifications of the exemplary embodiment shown are conceivable and possible, without departing from the scope of the invention as defined in the claims. It would therefore be possible for example for the connecting portions 12 also to be designed in some other way. For example, one of the two adjacent side walls could have an attached tongue (a tongue which lengthens the side wall) which, once the side walls have been folded into place, is bent or folded over and adhesively bonded to the adjacent side wall on the inside or outside.

The bottom 6 of the tray 1 and the top 56 of the lid 51 could also be of a shape which is not rectangular or square, for example they could be hexagonal or octagonal.

A packaging designed in the manner according to the invention may also be provided for packaging items other than foodstuffs, for example for household goods.

It would also be possible for the side walls 3, 5 which do not have any openings for interacting with the lug 57 to have a respective tongue which projects freely upward from a wall portion which is connected directly to the adjacent side walls, in a manner analogous to the tongues 9 of the side walls 2, 4. The lid 51 here could also have sloping portions which interact with these tongues, in a manner analogous to the sloping portions 59, so that, when the lid is being connected to the tray, these tongues can be pivoted in relation to the wall portion located beneath them, the result being that these tongues are at an angle in relation to the wall portions which are located beneath them.

Provision could also be made for at least one lug to be provided on all the side walls of the lid and, correspondingly, for at least one opening to be provided on all the side walls of the tray, a respective lug of the lid having been snap-fitted into an opening when the lid and the tray are in the connected state. In this case, preferably all the side walls would have a tongue which projects freely upward from the respective wall portion which has the at least one opening and which is connected via a bending line to this wall portion, in a manner analogous to the tongue 9, and the lid would preferably have sloping portions which interact with all the tongues.

KEY TO REFERENCE SIGNS

1 Tray
2 Side wall
3 Side wall
4 Side wall
5 Side wall
6 Bottom
7 Opening
8 Wall portion
9 Tongue
10 Bending line
11 Angle
12 Connecting portion
12*a* Triangular portion
12*b* Triangular portion
13 Bending line
14 Bending line
15 Bending line
16 Bending line
17 Bending line
18 Bending line
19 Bending line
51 Lid
52 Side wall
53 Side wall
54 Side wall
55 Side wall
56 Top
57 Lug
58 Wall portion
59 Sloping portion
60 Angle

The invention claimed is:

1. A packaging, comprising:

a tray made of cardboard or paperboard;

a lid which, when the packaging is in a closed state, is fitted on the tray and engages on an outside over an upper edge of the tray on the outside;

the lid including inwardly protruding lugs configured for holding the lid on the tray, the lugs being arranged on wall portions of at least two opposite side walls of the lid;

the tray including openings formed in wall portions of at least two opposite side walls of the tray, the lugs engaging in the openings in the closed state;

at least the two opposite side walls of the lid have, in each case in a region above the respective lugs, a sloping portion which extends in an inclined state in relation to a vertical direction and by which an extent of the lid increases from top to bottom;

at least the two opposite side walls of the tray which have the openings have, in each case in a region above the wall portion which has at least one of the openings, a freely upwardly projecting tongue, which is connected via a bending line to the wall portion which has the at least one of the openings, with the wall portion being located beneath the tongue; and in the fitted state of the lid, the tongues of the side walls butt against the sloping portions of the lid.

2. The packaging as claimed in claim 1, wherein in the closed state with the lid fitted on the tray, an interaction of the respective sloping portion of the respective opposite side walls of the lid aligned with the associated freely upwardly projecting tongue of the two opposite side walls of the tray decreases an angle between the tongue and the wall portion which has at least one of the openings, and to which said tongue is connected via the bending line.

3. The packaging as claimed in claim 1, wherein, in an unconnected state of the tray and the lid, a one of the respective tongues and the wall portion which has the at least one opening, and is located beneath the tongue, are located in a common plane.

4. The packaging as claimed in claim 1, wherein the sloping portions of the lid enclose an angle ranging from 35° to 55° in relation to the vertical direction.

5. The packaging as claimed in claim 1, wherein each respective one of the freely upwardly projecting tongues which is connected via the bending line to the wall portion which has at least one of the openings, extends over more than half of a longitudinal extent of the wall portion located there beneath.

6. The packaging as claimed in claim 1, wherein the wall portions which have the at least one opening are located in each case in an inclined state in relation to the vertical direction, and an extent of the tray increases from bottom to top.

7. The packaging as claimed in claim 1, wherein the side walls of the lid which have the lugs have in each case two of the lugs spaced apart over a width of the side wall, and the wall portions of the associated side walls of the tray have corresponding ones of the openings.

8. The packaging as claimed in claim 1, wherein the tray includes side walls located respectively between the two opposite side walls, and these side walls are arranged to follow one the other in a peripheral direction of the tray and are connected to one another via connecting portions which are adhesively bonded to at least a successive one of the side walls.

9. The packaging as claimed in claim 8, wherein the connecting portions each have a first and a second triangular portion, and in the state in which a blank of the tray has been laid out flat, the first and the second triangular portions are separated from an adjacent one of the side walls in each case by a bending line which extends from that corner of a bottom at which the respective connecting portion is arranged, and the first and the second triangular portions are separated from one another by a bending line which extends from the corner of the bottom and is at an angle of 135° in relation to a respective one of two side edges of the bottom which together enclose the corner.

10. The packaging as claimed in claim 1, wherein the lid is formed of plastic.

* * * * *